United States Patent [19]

Warrington

[11] 4,015,821

[45] Apr. 5, 1977

[54] CABLE TENSIONING ASSEMBLY

[75] Inventor: Henry G. Warrington, Boynton Beach, Fla.

[73] Assignee: Vulcan Iron Works, Inc., Chattanooga, Tenn.

[22] Filed: Jan. 14, 1976

[21] Appl. No.: 648,888

[52] U.S. Cl. ..... 254/29 A

[51] Int. Cl.[2] ..... E21B 19/00

[58] Field of Search ..... 254/29 A; 81/51.38; 92/169, 107

[56] References Cited

UNITED STATES PATENTS

| | | | |
|---|---|---|---|
| 3,115,332 | 12/1963 | Singleton et al. | 81/57.38 |
| 3,230,799 | 1/1966 | Maciulaitis | 81/57.38 |
| 3,815,874 | 6/1974 | Jones | 254/29 A |
| 3,938,427 | 2/1976 | Warrington | 254/29 A |

*Primary Examiner*—Al Lawrence Smith
*Assistant Examiner*—Robert C. Watson
*Attorney, Agent, or Firm*—Mason, Kolehmainen, Rathburn & Wyss

[57] ABSTRACT

An assembly for tensioning cables on a percussion hammer or the like wherein each cable has a threaded end fitting. The assembly includes a lock nut threadably mounted on the end fitting for locking the end fitting relative to the hammer. Also included in the assembly is a jacking sleeve threadably mounted on the end of the cable fitting and adjacent to the nut. A hydraulic jack body is mounted around the jacking sleeve and nut and abuts a portion of the hammer at one end thereof. The jack body includes a hydraulic cylinder and piston wherein the piston is mechanically connected to the jacking sleeve by a split ring. Movement of the piston due to the introduction of hydraulic fluid into the chamber imparts a corresponding movement to the jacking sleeve resulting in tensioning of the cable.

7 Claims, 4 Drawing Figures

CABLE TENSIONING ASSEMBLY

BACKGROUND OF THE INVENTION

A. Field of the Invention

The present invention is a new and improved device for tensioning cables on a pile driving hammer or the like.

B. Description of the Prior Art

Conventional percussion hammers such as are used for pile driving and the like normally include a ram reciprocally mounted on the hammer body movable between an upper cylinder and a body base. Typically, the base of the body is secured to the upper cylinder assembly by suitable tie means. One such means of tying the hammer base to the upper cylinder assembly is by use of tie cables interconnecting the hammer base and the upper cylinder assembly. Such cable ties must be equally prestressed to provide a hammer body resembling a rigid construction.

In the larger sizes of pile driving percussion hammers, such as those used in offshore operation and weighing in the range of thirty to sixty tons, it may be desired to prestress the cable ties to a final tension in the area of forty tons for each cable tie. Heretofore, difficulty has been experienced in the pretensioning of such cable ties.

Examples of prior art devices for tensioning cables or similar items are disclosed in United States Patent Application Ser. No. 441,027, filed February 11, 1974, now U.S. Pat. No. 3,938,427, and U.S. Pat. No. 2,866,370.

Prior art cable tensioning assemblies include a thread protector cap, a jacking bar assembly, a jacking pedestal, a hydraulic jack, a placement nut, and a locking or retaining nut. To tension or retension a cable on the hammer using the prior art assembly, it is necessary to remove the thread protector cap from the end of the cable fitting. The jacking bar assembly must then be screwed tightly onto the end of the cable fitting. The jack pedestal is then assembled over the jacking bar assembly in a position to abut a support plate mounted on the casing of the hammer.

This procedure is followed by assembling the hydraulic jack over the jacking bar and locking it onto the jacking bar assembly by a locking nut. Hydraulic pressure is applied to the jack thus tensioning the cable.

Once the desired tension is obtained, the retaining nut is rotated downward about the cable fitting locking the cable fitting in position relative to the jacking pedestal thus maintaining the tension on the cable once the pressure in the hydraulic jack is released.

Such prior art cable tensioning assemblies require two men to set up the assembly and tension a cable, since the individual components of the assembly are of considerably weight and require accurate positioning.

SUMMARY OF THE INVENTION

An object of the present invention is to provide a new and improved device for applying tension to a cable or the like.

Another object of the present invention is to provide a new and improved cable tensioning assembly for tensioning cables on a pile driving hammer or similar device.

A further object of the present invention is to provide a new and improved assembly for tensioning cables that is of a lighter weight, and fewer components than prior art assemblies thus allowing easier installation.

Briefly, the present invention is directed to a new and improved assembly to be employed with a percussion, pile driving hammer or the like to tension the cables holding the various components of the hammer in a rigid, as opposed to loose, assembly. The assembly includes a support plate mounted around a cable fitting secured on the end of a cable and abutting the body of the hammer. The plate serves as a base upon which the assembly is mounted.

Also included in the tensioning assembly is a retaining nut threaded onto the end of the cable fitting to a position abutting the support plate thus retaining the cable in a fixed position relative to the hammer body.

In accordance with an important feature of the present invention, the tensioning assembly includes a jack body mounted about the retaining nut so as to abut the support plate at one end. The jack body includes a piston and hydraulic cylinder wherein pressurized hydraulic fluid may be introduced to actuate the piston.

In accordance with a further important feature of the present invention, the assembly further includes a jacking sleeve that is threaded onto the end of the cable fitting adjacent to the retaining nut. It is this sleeve that imparts tension to the cable through a mechanical connection with the jack body. A split ring may be mounted onto the jacking sleeve in a position to abut the piston thus providing the mechanical connection to the piston.

Accordingly, upon introduction of pressurized hydraulic fluid into the hydraulic chamber of the jack body, the piston is moved against the ring imparting a corresponding movement to the jacking sleeve. Thus, the sleeve and the cable are tensioned relative to the plate and the hammer body.

Once the desired amount of tension is attained, the retaining nut is turned down the threads of the cable fitting to abut against the support plate thereby retaining the cable in that position relative to the hammer body.

BRIEF DESCRIPTION OF THE DRAWING

The above and other objects and advantages and novel features of the present invention will become apparent from the following detailed description of a preferred embodiment of the invention illustrated in the accompanying drawing wherein.

DESCRIPTION OF THE PREFERRED EMBODIMENT

Figure 1:
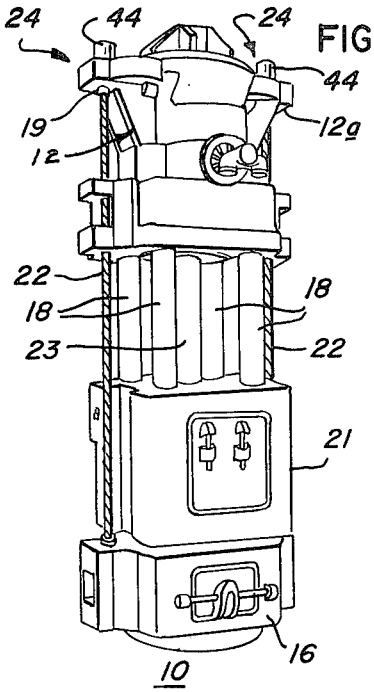
FIG. 1 is an elevation view of a percussion hammer having mounted thereon a tensioning assembly constructed in accordance with the principles of the present invention.

With reference to FIG. 1, therein is disclosed a percussion hammer 10 of the type well known in the art. The hammer 10 includes an upper cylinder body 12 and a lower base or plate 16. The cylinder body or housing 12 is connected to the base 16 by opposed glide columns 18 and held together by cables 22. Each of the cables 22 is secured to the lower plate 16 and extends through aperture 19 in projection 12a.

A ram assembly 21 is adapted to be reciprocated vertically guided by columns 18. A piston (not shown) in cylinder 12 is connected to the ram assembly 26 by rod 23.

The operating cycle of the percussion hammer 10 may be of any known type and may be of the type illustrated in U.S. Pat. No. 3,566,977, granted Mar. 2, 1970, to George C. Wandell.

Commercially available percussion hammers 10 of the type illustrated may weigh in the range of thirty to sixty tons; and in order to secure the base 16 with the upper housing portion 12a, the cables 22 may be prestressed or loaded to a load of approximately forty tons each. The preloading of the cables 22 may be readily accomplished in accordance with the present invention by a suitable cable tensioning assembly 24 illustrated at the upper end of each cable 22 (FIG. 1).

Figure 4:
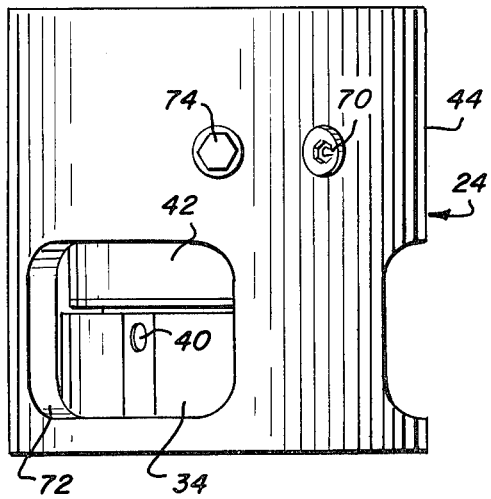
FIG. 4 is an elevation view of the device of the present invention constructed in accordance with the principles of the present invention.
Figure 2:
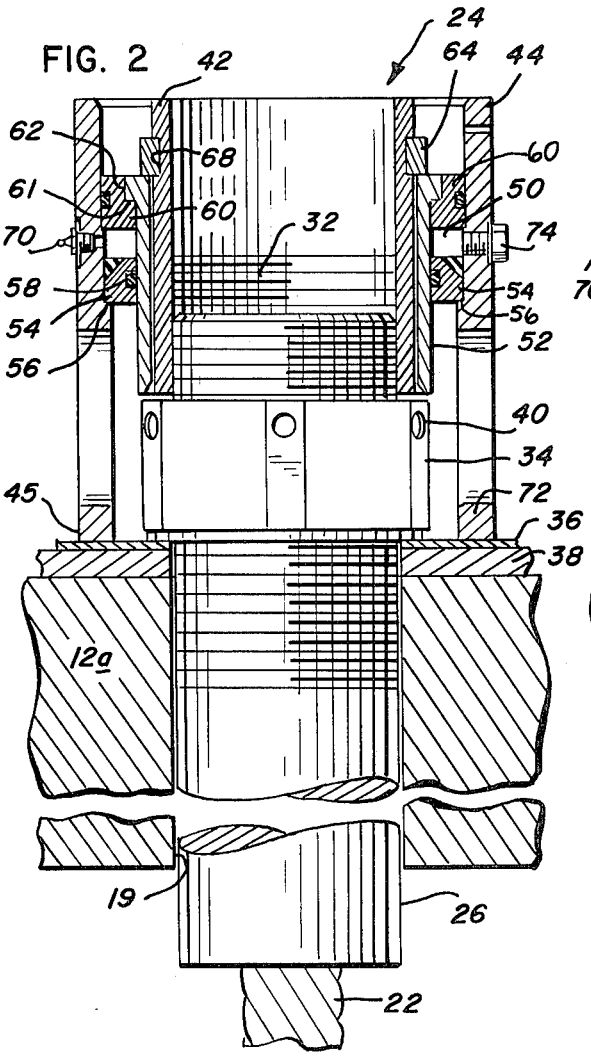
FIG. 2 is an enlarged cross-sectional view of the device of the present invention.
Figure 3:
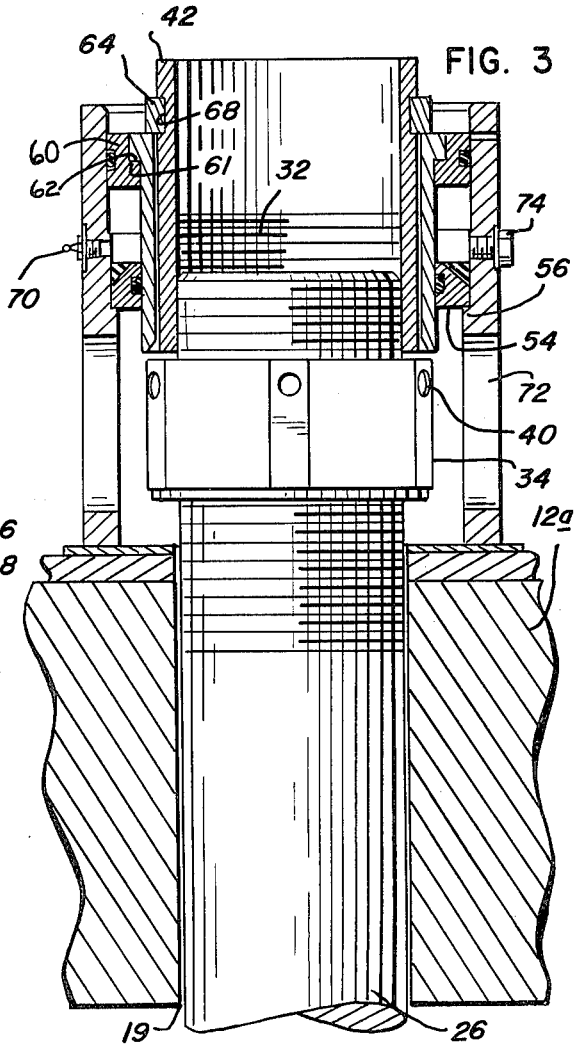
FIG. 3 is a cross-sectional view of the device of the present invention similar to that of FIG. 2 but in a tensioning configuration.

With reference to FIGS. 2–4, in order to tension a cable 22, an end fitting 26 is rigidly secured to the end of the cable 22 passing into and through opening 19 in extension 12a. The end fitting 26 includes threads 32 at one end thereof.

In this configuration, a locking nut 34 may be screwed onto the threads 32 to a position abutting a lock washer 36 that is positioned upon wear plate 38; both of which are mounted upon the upper surface of extension **12*a*. The lock washer 36 and plate 38 provide a uniform locking surface for nut 34. Thus, once nut 34 is tightened against washer 36, the end fitting 26 is locked in a position relative to the extension 12*a***.

The lock nut 34 includes apertures 40 into which a wrench or similar device (not shown) may be inserted to rotate the lock nut 34 on the threads 32 of the end fitting 26 thus changing the position of the lock nut 34 and the end fitting 26 relative to extension **12*a***.

In further assembling the tensioning assembly 24 onto end fitting 26, there is provided a jacking nut 42 that is screwed onto the extended threaded end of the end fitting 26 (FIG. 2). After the jack nut 42 is threaded onto the end fitting 26, a jack body 44 is mounted over the jacking nut 42 and the lock nut 34 to a position such that the lower end 45 of body 44 abuts against the lock washer 36. Lock washer 36 and plate 38 provide a uniform base for the jack body 44.

The jack body 44 includes a piston chamber 50 defined between the inner peripheral surface of the jack body 44 and a pressure sleeve 52. In addition, the piston chamber 50 is further defined at the bottom thereof by sealing ring 54 that locks against a shoulder 56 fabricated on the inner peripheral surface of the jack body 44. The sealing ring 54 further includes an O-ring 58 to prevent leakage of hydraulic fluid, oil, or the like from chamber 50.

The upper portion of the piston chamber 50 is defined by a piston 60 that is fitted to slide along the inner peripheral surface of the jack body 44. The piston 60 is in locking arrangement with the pressure sleeve 52 by interaction of the shoulder 61 and flange 62 arrangement of the piston 60 and sleeve 52, respectively.

The jacking nut 42 and the jack body 44 are mechanically connected through the utilization of a split ring 64. The ring 64 is fitted in a groove 68 fabricated in jacking nut 42 so as to abut the upper end of sleeve 52. In this configuration, the piston 60, and thus, the jack body 42, is mechanically connected to the jacking nut 42.

To operate the assembly 24 in tensioning the cable 22, hydraulic fluid under high pressure may be applied by a grease gun or similar device (not shown) through fitting 70 into the piston chamber 50. As the pressure in the piston chamber 50 increases, the piston 60 is elevated causing the jacking nut 42 to be also elevated through the interaction of the mechanical connection of the split ring 64 (FIG. 3). As the jacking nut 42 is elevated and with it the fitting 26, the cable 22 is extended and, thus, tensioned.

Once the desired tension in the cable 22 is attained, the introduction of pressurized fluid by the grease gun is terminated and the lock nut 34 tightened down on the threaded end 26 to abut the lock washer 36. This may be done by the introduction of a wrench through openings 72 in the jack body 44. The wrench is inserted into the apertures 40 and the nut 34 is then threaded downwardly on the threads 32.

By turning the lock nut 34 down to abut with the lock washer 36, the end fitting 26 is again locked or positioned relative to the portion 12a such that upon releasing the pressure in the piston chamber 50, the cable 22 will not lose its tension.

Additionally, there is provided a relief valve 74 for preventing an undesirable level of pressure to be introduced into the piston chamber 50. The relief valve 74 will allow this pressure to be relieved thereby avoiding undesirable damage.

The tensioning assembly 24, as described, eliminates the hydraulic jack, the jacking pedestal, and the jacking bar assembly of the prior art devices and is replaced by the split ring 46, jack body 44 and the jacking nut 42. Accordingly, the number of parts and resultant difficulties in tensioning cables on percussion hammers or the like are substantially reduced.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An apparatus for tensioning a cable having a threaded fitting on one end thereof, said apparatus comprising a base positioned around said fitting, a movable retaining element positioned on said fitting and adjacent said base, a sleeve removably secured to said fitting and adjacent said element, a jack member positioned over said fitting having one end abutting said base, said jack member including piston means for tensioning said cable, and an abutment member secured to said sleeve and adapted to abut said piston means to provide a mechanical connection between said sleeve and said sack member.

2. An apparatus as set forth in claim 1, said retaining element comprising a nut threadably mounted on said fitting so that after tensioning said cable, said nut may be threaded on said fitting to abut said base and retain said cable in its tensioned configuration.

3. An apparatus as set forth in claim 1, said abutment member comprising a ring.

4. A cable tensioning assembly for tensioning cables on an industrial hammer, each said cable being connected to said hammer at one end thereof and including a threaded cable fitting on a second end thereof that passes through an opening in the body of said hammer, wherein said assembly comprises a support base positioned around said fitting and abutting said body, a nut threaded on said fitting adjacent said plate, a jacking sleeve threaded on the end of said fitting adjacent said nut, a hydraulic jack cylinder supported on said plate surrounding said sleeve and nut, said jack cylinder including a hydraulic chamber and piston slidably mounted therein, and a ring on said sleeve and abutting said piston thereby providing a mechanical connection of said piston to said sleeve such that movement of said piston due to introduction of fluid into said chamber imparts corresponding movement to said sleeve thereby tensioning said cable.

5. In combination a body, a cable secured to one end of said body having a threaded cable fitting secured on a second end thereof passing through a second end of said body, and a cable tensioning assembly comprising a locking member threadably positioned on said fitting, a first sleeve threadably secured to said fitting, a jack assembly mounted on said body and co-axial relative to said fitting and said first sleeve, said jack assembly including a hydraulic piston and a second sleeve coupled to said piston, and a lock device mounted on said first sleeve and abutting said second sleeve thereby locking said first sleeve relative to said second sleeve and said piston.

6. The combination set forth in claim 5 said lock device comprising a ring mounted on the outer peripheral surface of said first sleeve.

7. The combination set forth in claim 5 said locking member comprising a nut.

* * * * *